US005406966A

United States Patent [19]

Lepkowski et al.

[11] Patent Number: 5,406,966

[45] Date of Patent: Apr. 18, 1995

[54] EAVE TROUGH AND DOWNSPOUT CLEANING SYSTEM AND COMPONENTS THEREFOR

[76] Inventors: Donald E. Lepkowski, 425 Victoria Park Dr., Tallmadge, Ohio 44278; Paul M. Halter, 1090 Carol La., Tallmadge, Ohio 44278

[21] Appl. No.: 151,145

[22] Filed: Nov. 12, 1993

[51] Int. Cl.[6] ..... B08B 3/02

[52] U.S. Cl. ..... 134/104.4; 134/166 R; 210/162; 210/446; 210/452

[58] Field of Search ..... 134/104.4, 166 R, 166 C, 134/167 R, 167 C, 168 R, 168 C, 169 R, 169 C; 52/16; 210/162, 446, 447, 451, 452, 459; 137/544, 550

[56] References Cited

U.S. PATENT DOCUMENTS

| | | | |
|---|---|---|---|
| 381,990 | 5/1888 | Driller | 210/446 X |
| 1,112,117 | 9/1914 | Carbis | 137/544 X |
| 1,471,215 | 10/1923 | Sigman | 210/446 |
| 1,552,902 | 9/1925 | Werner | 210/446 X |
| 2,419,501 | 4/1947 | Pinto | 210/452 X |
| 2,754,972 | 7/1956 | McCann | 210/451 X |
| 2,865,674 | 12/1958 | Jelmeland | 52/16 X |
| 2,887,073 | 5/1959 | Thompson | 52/16 |
| 3,063,566 | 11/1962 | Hanley | 210/446 X |
| 3,628,668 | 12/1971 | Huppert | 210/446 |
| 4,183,368 | 1/1980 | Husted | 134/166 R |
| 4,194,372 | 3/1980 | Keller . | |
| 4,472,274 | 9/1984 | Williams | 210/447 X |
| 4,523,875 | 6/1985 | DiFiore | 210/446 X |
| 4,765,352 | 8/1988 | Strieter | 134/104.4 X |
| 4,798,028 | 1/1989 | Pinion | 52/16 |
| 4,972,863 | 11/1990 | Morrow | 134/166 R |
| 5,114,594 | 5/1992 | Rosebrock et al. | 210/446 X |
| 5,119,849 | 6/1992 | Hinkley | 134/166 C X |

*Primary Examiner*—Philip R. Coe

*Attorney, Agent, or Firm*—Renner, Kenner, Greive, Bobak, Taylor & Weber

[57] ABSTRACT

A cleaning system (10) for an eave trough (11) and a downspout (12) includes a conduit assembly (13) extending along a portion of the downspout (12) and along at least a partial length of the eave trough (11), and a strainer assembly (14) interposed with respect to the downspout (12). A plurality of spaced spray nozzles (16) extend from the conduit assembly (13) and spray water toward the junction (17) of the eave trough (11) and downspout (12). A fitting (19) is connected to one end the conduit assembly ( 13 ) and is adapted for interengagement with a hose (20) which provides for a source of water under pressure. The spray of water allows for the flushing or purging of the eave trough (11), directing debris for the eave trough (11) to and through the downspout (12). The strainer assembly (14) includes a T-shaped housing (22) having an open upper end (25), an open lower end (26), and an open extension (27) extending orthogonally between the upper end (25) and the lower end (26), a strainer (23) operatively attached at the upper end (25) within the housing (22) for collecting the debris which passes through the downspout (12), and a stopper disc (24) selectively removable from the lower end (26) of the housing (22) which redirects the flow of water while purging. The strainer (23) and the stopper disc (24) are removable through the open extension (27) of the housing (22).

17 Claims, 4 Drawing Sheets

EAVE TROUGH AND DOWNSPOUT CLEANING SYSTEM AND COMPONENTS THEREFOR

TECHNICAL FIELD

The invention herein relates to a cleaning system for an eave trough and downspout. More particularly, the invention relates to a cleaning system having a conduit extending along a portion of the downspout and along at least part of the eave trough, the conduit having a plurality of spray nozzles which are directed to spray water into the eave trough and which are angled toward the junction of the eave trough and the downspout. The cleaning system also includes a strainer assembly which is interposed in the downspout at a height which is readily accessible to an individual. Specifically, the strainer assembly includes a removable strainer for removing debris from the downspout and a removable stopper disc for redirecting the flow of water through an alternative outlet.

BACKGROUND OF THE INVENTION

Eave troughs and downspouts are commonly found at the lowermost edges of sloping roofs in order to collect and carry away rain water from the tops of houses and other building structures. However, in order to function correctly and effectively, the eave troughs and downspouts must be kept free of debris such as dirt, leaves, twigs and the like. Accordingly, the eave troughs and downspouts must be periodically cleaned.

Typically, this has been done by climbing a ladder and using some type of brush or other instrument to remove the debris from the eave trough and/or downspout. However, using a ladder or standing on the roof are dangerous activities for persons performing this task. Moreover, the task is very burdensome and unsanitary for the individual undertaking the task.

In order to reduce the danger associated with climbing ladders and mounting roofs as well as to reduce the burden and mess associated with cleaning the drainage system in this manner, attempts have been made to provide effective cleaning and purging systems for eave troughs and downspouts which do not require the user to employ a ladder or to leave the ground. For example, Thompson U.S. Pat. No. 2,887,073 relates to a gutter and downspout cleaning system which includes an inlet pipe that leads up to the end of the eave trough from the corner of the building opposite the downspout. A water conduit attached to the inlet pipe may be used to provide a flow of water which is intended to aid in cleaning the eave trough of debris. However, one disadvantage of this prior art system relates to the fact that the spaced orifices along the horizontal pipe act merely to squirt water into the eave trough at right angles to the length of the eave trough such that no advantage is gained from the velocity of the injection of water. While the injection of the water may be sufficient to loosen debris directly below the spaced orifices which dispensed the water, it does not provide sufficient force to move the debris along the eave trough to the downspout. In many instances, the gravitationally induced flow of the typical eave trough is not adequate to move the debris along the length of the eave trough. Thus, grit and gravel from shingles and the like may remain and accumulate in a flow obstructing manner in the eave trough.

Moreover, the inlet pipe at the opposite side of the building from the downspout requires attention be directed toward two locations in order to adjust the flow of water and to clean the system. This problem of having the inlet pipe at a different end of the building away from the downspout is also noted in Husted U.S. Pat. No. 4,183,368.

In order to remove the debris from the downspout, several patents have provided downspout traps or strainer assemblies. For example, U.S. Pat. No. 2,887,073 uses a basket to collect leaves and the like. The basket is preferably wire mesh or the like and is provided with a handle. A door is located on the downspout to allow access to the basket therein. However, such doors have been known to leak. Similarly, DiFiore U.S. Pat. No. 4,523,875 provides a spring-biased closure for releasably closing the opening formed in the wall of the downspout. Notably, in this patent, it is desired that at least some of the water as well as the debris exit the downspout via this opening.

Pinion U.S. Pat. No. 4,798,028 discloses a downspout trap including a vertically disposed tubular body member having an upper portion of a size enabling it to be moved telescopically over the lower end of a downspout and a lower portion of a size engageable in a drain line, the lower portion having a screen therein. In order to remove debris from the downspout, the entire downspout trap and clean out assembly must be removed. Not only is this procedure time consuming and complicated, but also it is ineffective and messy when additional water is poured through the system in order to make sure that the eave trough and downspout are thoroughly cleaned.

Thus, a need exists for an eave trough and downspout cleaning system which will effectively clear the eave trough and downspout of debris without the person cleaning the drainage system having to move from one location to another in order to operate the system or to engage in any dangerous activity. Also, a need exists for a strainer assembly which eliminates doors which may readily leak, but which can be retrieved without having to disengage the entire assembly.

SUMMARY OF INVENTION

In light of the foregoing, it is, therefore, a first aspect of the present invention to provide a cleaning system for eave troughs .and downspouts which is adequate to clear the eave troughs and downspouts of debris.

It is another aspect of the present invention to provide a cleaning system, as above, which does not require an individual to climb a ladder or otherwise mount the roof of the house.

It is yet another aspect of the present invention to provide a cleaning system, as above, which permits an individual to remain at one location throughout the cleaning process.

It is still another aspect of the present invention to provide a strainer assembly from which debris may be removed without disengaging the entire strainer assembly.

It is yet a further aspect of the present invention to provide a strainer assembly, as above, wherein the strainer may be removed.

At least one or more of the foregoing aspects, together with the advantages thereof over the known art, which will become apparent as the detailed description proceeds are accomplished by a cleaning system for an eave trough and a downspout, comprising: conduit means extending along the downspout and at least a portion of the length of the eave trough for carrying water therethrough; means connected to the conduit means for spraying water into the eave trough in the general direction of the downspout; and a strainer assembly interposed with the downspout and including a T-shaped housing having an open upper end, an open lower end, and an open extension extending orthogonally between the upper end and the lower end, strainer means operatively attached at the upper end within the housing for collecting any debris which may pass through the downspout; and stopper means selectively removable from the lower end of the housing for redirecting the flow of water during cleaning; the open extension providing an access for removing the strainer means and the stopper means as desired.

Other aspects of the invention which will become apparent herein are attained by a strainer assembly, comprising: a generally T-shaped housing having an open upper end, an open lower end, and an open extension extending orthogonally between the upper end and the lower end; strainer means operatively attached at the upper end within the housing for collecting any debris which may pass through the assembly; and stopper means selectively removable from the lower end of the housing for redirecting the flow of water during cleaning; the open extension providing an access for removing the strainer means and the stopper means as desired.

BRIEF DESCRIPTION OF THE DRAWINGS

For a complete understanding of the objects, techniques and structure of the invention, reference should be made to the following detailed description and accompanying drawings wherein.

PREFERRED EMBODIMENTS FOR CARRYING OUT THE INVENTION

Figure 1:
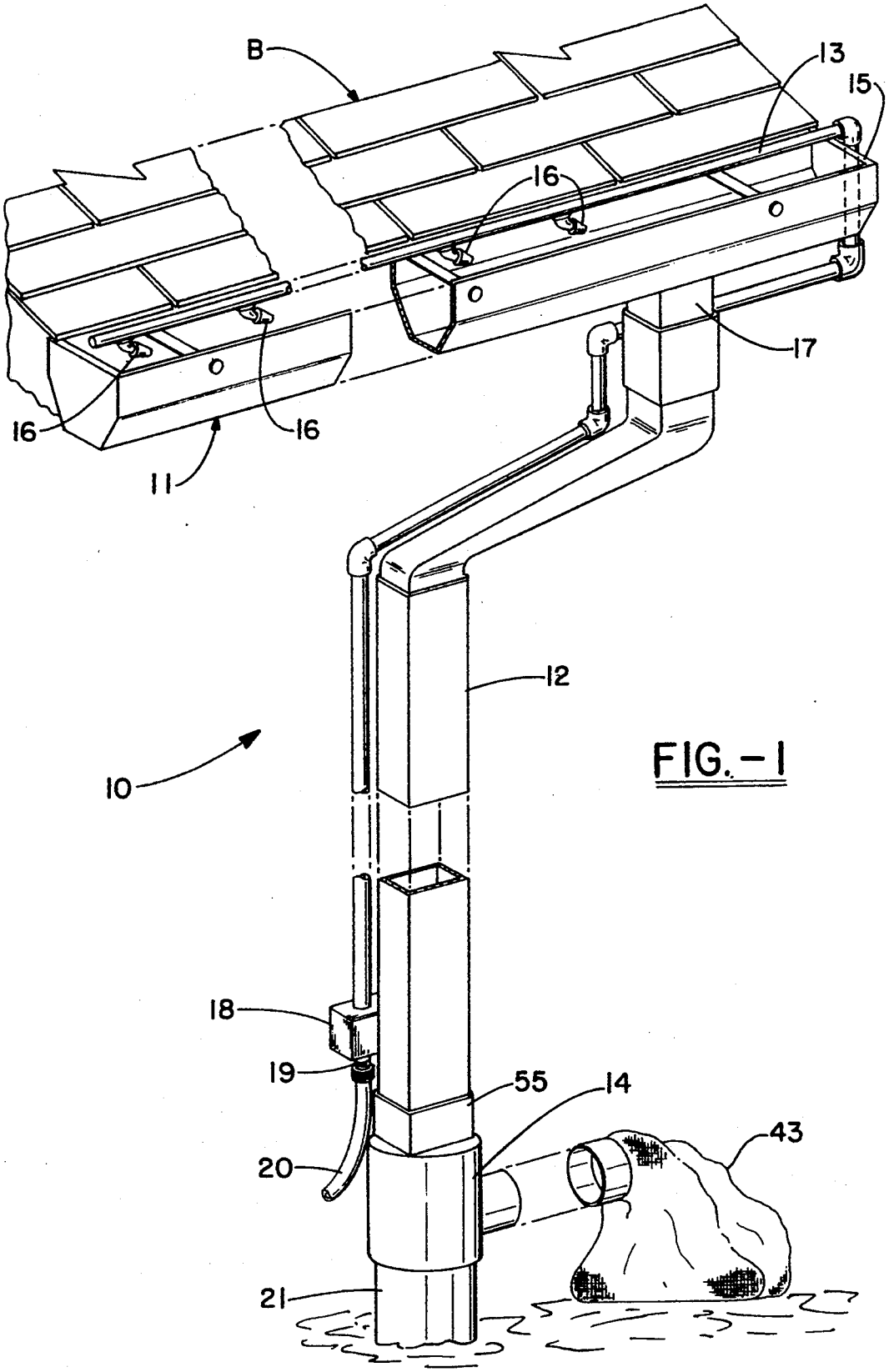
FIG. 1 is a perspective view of an eave trough and downspout cleaning system according to the present invention as shown operatively installed on a building.

A cleaning system according to the concepts of the present invention is indicated generally by the numeral 10 in FIG. 1 and is shown as securely attached to and operatively a part of a drainage system installed on a building B. The drainage system includes an eave trough 11 operatively attached along the roof line of the building B and a downspout 12 operatively interconnected to one end of the eave trough 11. Notably, the drainage system must be cleaned periodically in order to keep debris such as leaves, dirt and the like from clogging it. The cleaning system 10 is used to remove this debris from the eave trough 11 and downspout 12. It includes a water conduit assembly 13 for flushing water through the drainage system and a strainer assembly 14 for collecting and removing the debris.

Figure 2:
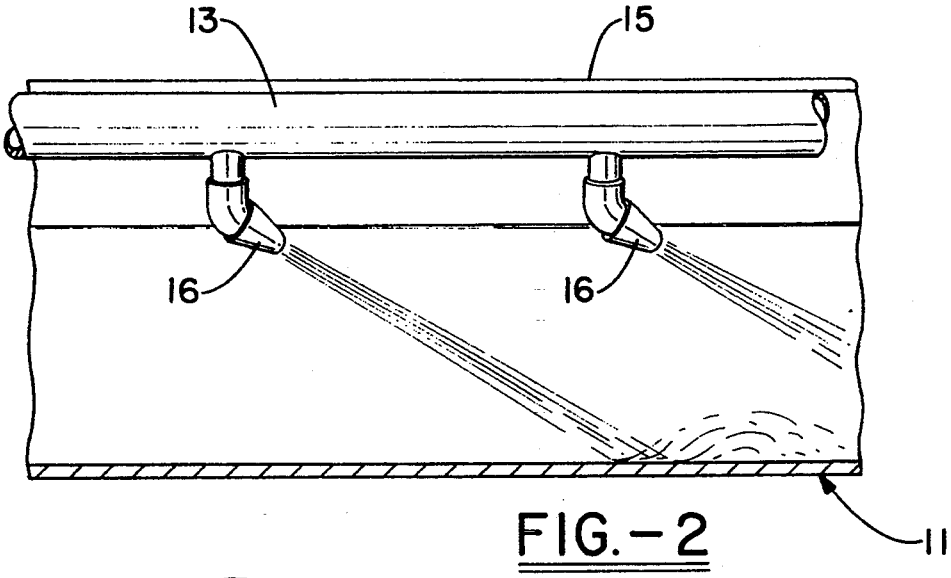
FIG. 2 is an enlarged partial view of the cleaning system of FIG. 1 taken along line 2—2 in FIG. 1.
Figure 6:
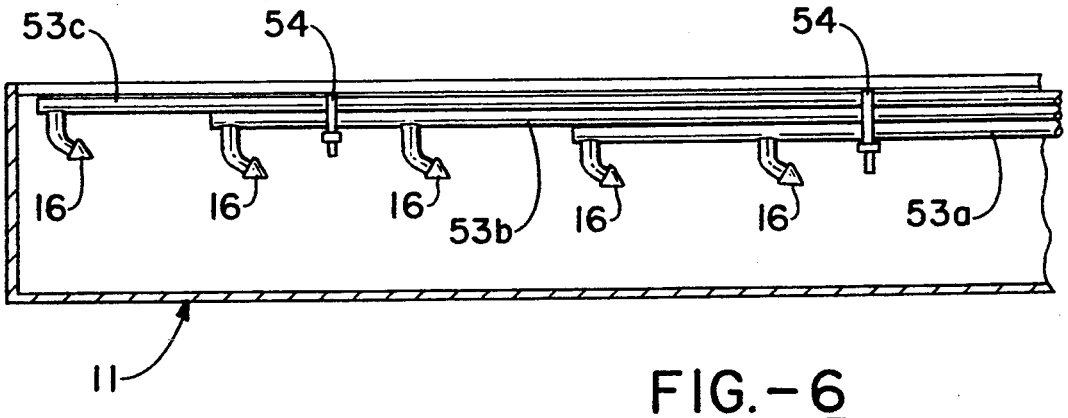
FIG. 6 is an enlarged parties view of an alternative embodiment of the cleaning system of the present invention.

As shown in FIG. 1, the cleaning system 10, and more particularly, the water conduit assembly 13 extends up one side of the downspout 12 until it meets the eave trough 11 and then extends along at least a portion of the eave through 11. Preferably, as shown in FIG. 2, the conduit assembly 13, which may include a plurality of individual conduit lines as shown in FIG. 6 and detailed hereinbelow, is affixed to an upper top lip 15 of eave trough 11. Extending from and spaced along the water conduit assembly 13 along the eave trough 11 is a plurality of spray nozzles 16. Each nozzle 16 may be connected to one of the individual conduit lines and is preferably positioned and angled to spray water into the eave trough 11 toward the junction 17 of the eave trough 11 and the downspout 12. Accordingly, the velocity of the water when injected :into the eave trough 11 aids in loosening the debris found in eave trough 11 and in forcibly moving the debris toward the downspout 12. At or near the end of the conduit assembly 13 attached to the downspout 12 and proximate to or slightly above the strainer assembly 14, a valve box 18 is provided. The valve box may include a fitting 19 for operative engagement with a hose 20 or other means to carry water from a source under pressure such as a water spigot.

More specifically, as shown in FIG. 6, the valve box 18 may include a water chamber 50 and a plurality of valves 51 extending therefrom. The fitting 19 may be attached at or near the bottom of the water chamber 50 and may extend outwardly toward the front of the valve box 18 so as to provide for an easy attachment to the hose 20. The valves 51 may be selectively opened and closed by turning the valve knobs 52 such that one or all of the valves may be operated at any one time. Each valve 51 has one of the conduit lines 53 of the conduit assembly 13 attached to it. The conduit lines 53 are preferably bundled in a manner known in the art such as by ties 54 as shown in FIG. 6, and extend up the downspout 12 like the conduit assembly 13 discussed hereinabove. Each conduit line 53*a*, 53*b*, 53*c*, etc. may then extend to a predetermined area of the ease trough 11 as shown in FIG. 6. That is, each conduit line 53*a*, 53*b*, 53*c*, etc. will extend a predetermined distance and have a certain number of nozzles 16 such that it is possible to sequentially spray from one end of the ease trough 11 to the other so that debris is moved along as more particularly detailed hereinbelow.

The other major component of the cleaning system 10 is the strainer assembly 14 which is preferably positioned between the downspout 12 and a drain pipe 21 as shown in FIG. 1. In this position, the strainer assembly 14 is readily accessible to the homeowner or the person cleaning the eave trough 11 and downspout 12. It should be understood, however, that the strainer assembly 14 may be interposed between two pieces of the downspout 12 without departing from the spirit of the invention. When this is done, an adapter such as 55 shown in FIG. 1 at the top of strainer assembly 14 may be employed, if necessary, to position the strainer assembly 14 onto the downspout 12.

Figure 3:
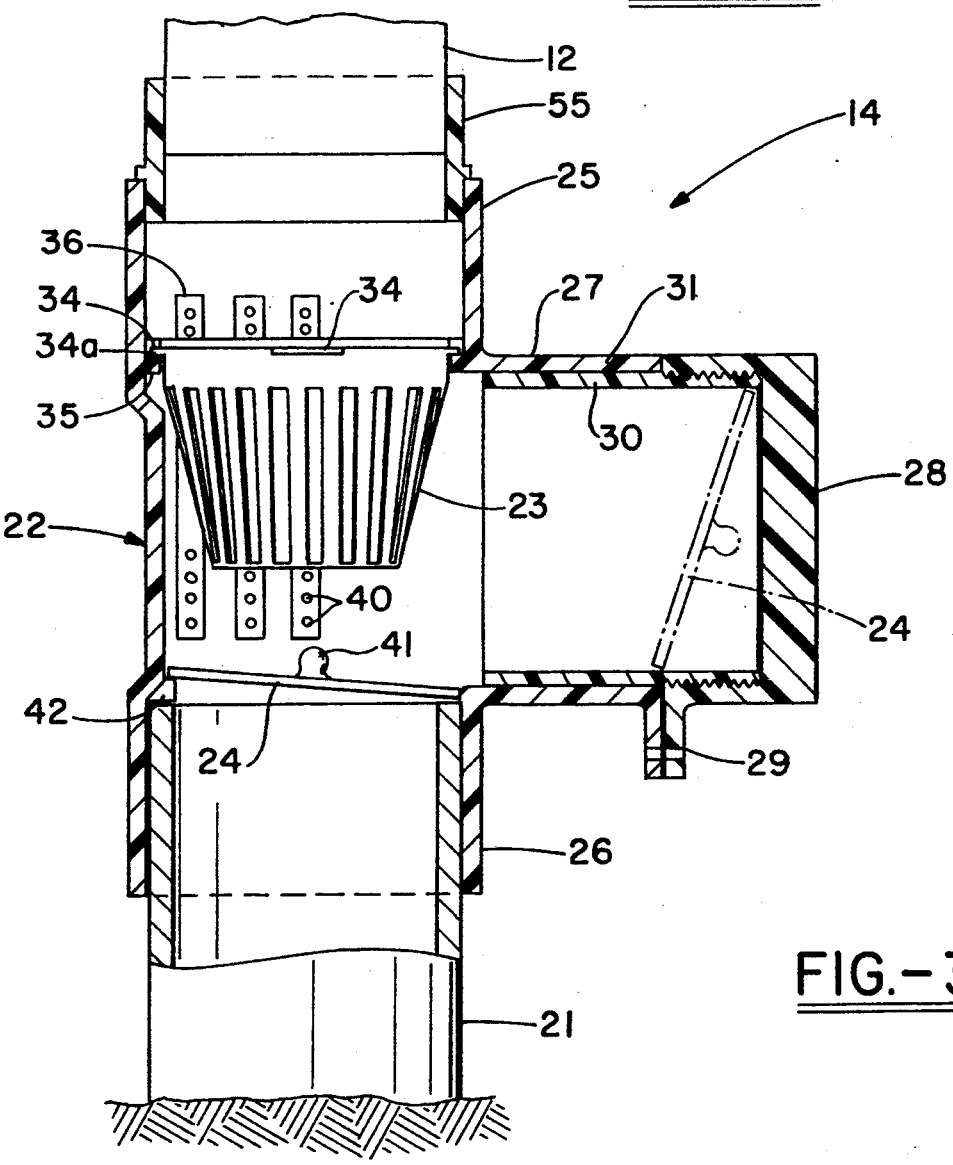
FIG. 3 is a longitudinal sectional view of a strainer assembly of the present invention.

As best shown in FIG. 3, the strainer assembly 14 includes a generally T-shaped hollow housing pipe 22, a strainer 23 operatively and removably attached inside the housing pipe 22, and a stopper disc 24 also adapted to be received within the housing pipe 22. Preferably, each of these components may be molded of plastic or other similar sturdy material suitable for use in a drainage system. The housing pipe 22 generally includes an open upper end 25 operatively communicating with and receiving the lower portion of the downspout 12 or adapter 55 and a open lower end 26 operatively communicating with and affixed to the upper portion of the drain pipe 21 or another adapter 55. Both the upper and lower ends 25, 26 are preferably cylindrical, but it will be appreciated that the cross-sectioned shape of each end may be of any configuration known in the art which will permit the strainer assembly 14 to operate in the manner detailed hereinbelow or, in the alternative, may be of sufficient size to accommodate the operative engagement of an adapter 55 for changing the configuration of the ends from circular to rectangular or any other shape or diameter as may be required.

In addition to the ends 25, 26, a similarly shaped, hollow, open extension or leg 27 extends generally orthogonally between the upper and lower ends 25, 26 and provides a suitable access to the interior portion of the strainer assembly 14 for selectively removing and replacing the strainer 23 and stopper disc 24 as desired. A cap 28 is provided to selectively close the open extension 27. The cap 28 may be threaded into position as shown in FIG. 3 or may be removably attached to the open extension 27 by any other means known in the art. A locking mechanism 29 interposed between the open extension 27 and the cap 28 may also be included to prevent unauthorized removal of the cap 28.

A close inspection of the open extension 27 in FIG. 3 shows that it includes an inner, preferably cylindrical pipe 30, a portion of which is affixed to an outer, preferably cylindrical pipe 31 such that the inside diameter of the outer pipe 31 matches the outside diameter or the inner pipe 30. A portion of inner pipe 30 extends beyond outer pipe 31 and is received by the cap 28 as can be seen in FIG. 3. It will be appreciated, however, that this design is not the only means for connecting the cap 28 to the open extension 27. For example, it is also possible to provide the cap 28 with a portion of inner pipe such that this inner pipe on the cap 28 may be removably secured to the outer pipe 30 of the strainer assembly 14. Other means of attachment may also fall within the scope of the invention.

The strainer 23 is operatively positioned inside the housing pipe 22 in strainer assembly 14 so that it will collect any debris which might inadvertently pass through the downspout 12. Preferably, as shown in FIG. 3, the strainer 23 is frustoconical in shape and is comprised of several bars 32 which form a cage-like or mesh-like structure. The bottom 33 of the strainer 23 also includes several openings through which water is permitted to flow. Thus, the strainer 23 acts as a filter for large debris such as twigs, leaves and the like.

Figure 4:
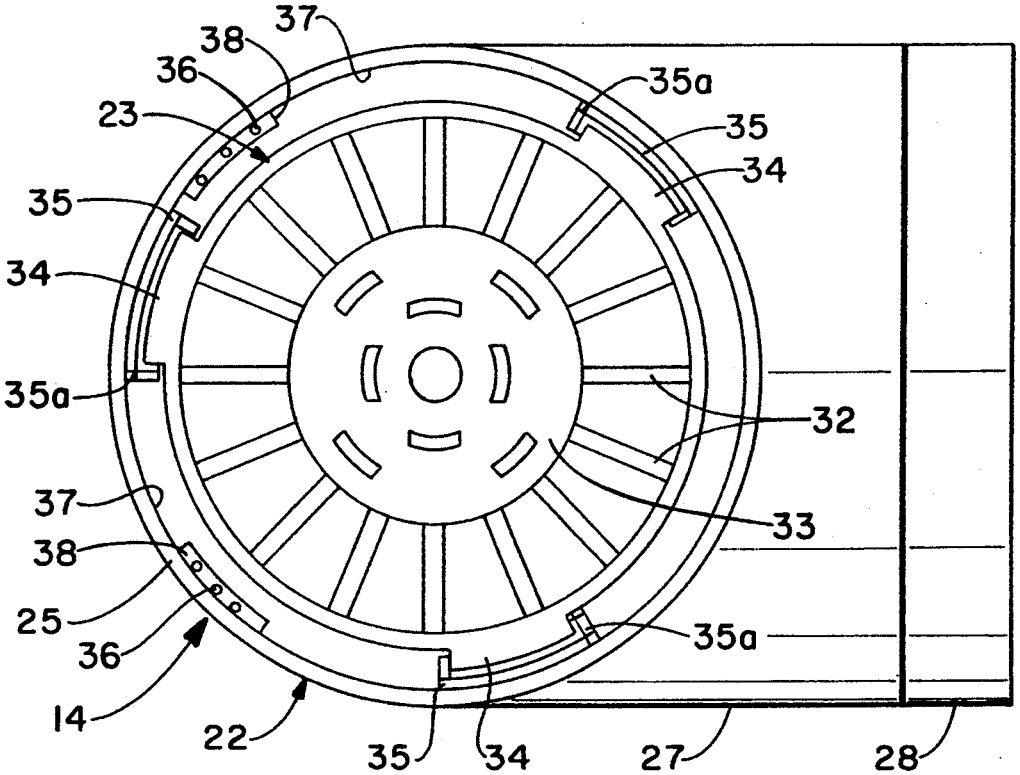
FIG. 4 is a top plan view of the strainer assembly of FIG. 3.
Figure 5:
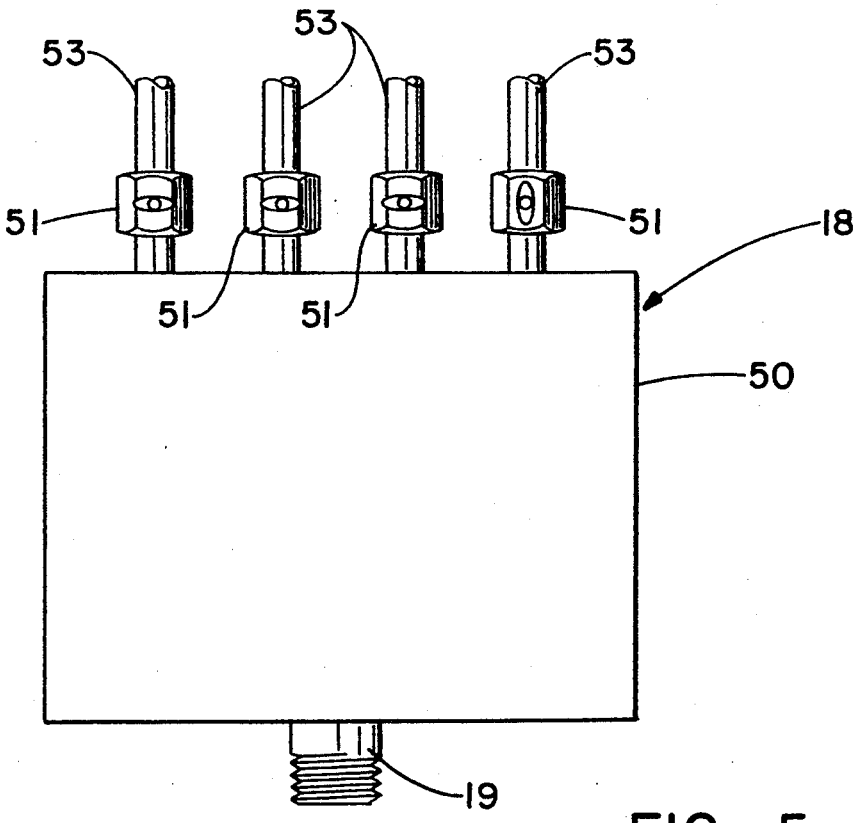
FIG. 5 is a side elevational view of a valve box assembly suitable for selectively operating the cleaning system of FIG. 1.

As best shown in FIG. 4, the top of strainer 23 is preferably cylindrical to complement the shape of the upper end 25 of the housing pipe 22. In addition, the top of strainer 23 includes locking means for selectively engaging the strainer 23 to pipe 22. One embodiment in which this connection can be made is shown in FIG. 4. There, the top of the strainer 23 includes at least two ears 34 which extend outwardly from the radial center of the top of the strainer 23. Complementary ribs 35 project inwardly within the housing pipe 22 and are spaced such that the ears 34 can be received therebetween and inserted above the ribs 35, as shown. Once the ears 34 are positioned properly with respect to the ribs 35, the strainer 23 may be twisted slightly such that the ears 34 are locked into position with ribs 35. Specifically, the nub **34*a* on ear 34 may be received by a slot 35*a* on rib 35 so as to lock the striner 23 into place. In this condition, the strainer 23 is operatively locked into position and cannot fall out of the upper end 25 of the housing pipe 22. It should be understood that there are several ways to selectively position the strainer 23 within the housing pipe 22 and that the particular preferred embodiment described hereinabove is used by way of example and therefore, the present invention should not necessarily be limited thereto. It is noted that, as an alternative embodiment, the strainer 23 could be threadably received by the pipe 22, similar to the preferred embodiment for securing the cap 28 to the open extension 27**.

With further reference to FIGS. 3 and 4, means such as bleed-off lines 36 to permit water to escape past the strainer assembly 14 should the strainer 23 become completely clogged and closed off may also be provided within the housing pipe 22. Preferably, at least one elongated bleed-off line 36 is provided along the inside surface 37 of housing pipe 22 and is preferably integrally connected thereto. As more particularly shown in FIG. 4, where more than one bleed-off line 36 is used, a holding rib 38 projecting inwardly from the housing pipe 22 may securely affix and hold the bleed-off lines 36 in position against the inside surface 37 of the housing pipe 22. As shown, the bleed-off lines 36 are positioned beyond the reach of the ears 34 of the strainer 23 and thus, do not present a impediment to the implementation of the stainer 23. Each bleed-off line 36 generally includes a plurality of holes 40 extending down its length such that the water to be removed through the drainage system may enter the bleed-off line 36 above the strainer 23 and gravitationally descend through and exit the line 36 through holes 40 provided in the bleed-off line 36 below the strainer 23.

It will be appreciated that the bleed-off lines 36 may extend significantly above the top of the strainer 23. The greater such extension, the greater the chance that the system will remain unclogged, even when the strainer becomes full of debris to the extent that the debris extends over the top of the stainer.

In order to redirect the flow of water when purging the drainage system, the stopper disc 24, preferably having a gripping post 41 extending from one side thereof, is provided. The disc 24 is preferably made of plastic or other suitable rigid material and is substantially circular or of some shape complementary to the configuration of the pipe 22 so as to be received within the housing pipe 22 and to block the flow of water through the lower end 26 of the strainer assembly 14. The disc 24 is supported by a circumferential lip 42 extending inwardly from the lower end 26 of housing pipe 22. Preferably, the disc 24 is inclined away from the open extension 27 within strainer assembly 14 at an angle of about 5 degrees in order to provide a sufficient gravitational force to permit any debris which may inadvertently fall through the downspout 12 and/or the strainer 23 to be washed away and out of the drainage system through the open extension.

In normal use, the stopper disc 24 is removed from the strainer assembly 14, the strainer 23 is securely placed in the upper end 25 of pipe 22, and the cap 28 is securely attached to the open extension 27 such that the eave trough 11 and downspout 12 operate in standard fashion, with the strainer 23 receiving any debris which might inadvertently pass through the downspout 12 and water passing to the drain pipe 21. It is suggested that the stopper disc 24 be housed in the cap 28 or open extension 27 while not is use as as shown in phantom in FIG. 3. When it is desired to clean the strainer 23 or purge the eave trough 11 and downspout 12, the cap 28 is removed from the open extension 27 to allow the person cleaning the drainage system to remove and clean the strainer 23 by dislodging it from the upper portion of the pipe 22 and removing it via the open extension 27. Importantly, the open extension 27 must be large enough to permit the strainer 23 to be removed therethrough. In this way, the housing pipe 22 is never removed from the drainage system.

If the purging operation is to be undertaken, the :hose 20 may be attached to the fitting 19 and the stopper disc 24 may be inserted through the open extension 27 into its position upon the circumferential lip 42 in the lower end 26 of the strainer assembly 14. As the water is turned on and sprayed through water conduit assembly 13 and out nozzles 16, leaves, dirt and other types of debris within the eave trough 11 are forced toward the downspout 12 and therethrough.

Where the valve box 14 is utilized, sequential spraying may be employed. That is, the nozzle at the end of the ease trough opposite the downspout would first be actuated by opening the first valve communicating with the conduit line leading to that particular nozzle. After a period of time sufficient to move the debris into the effective range of the next subsequent nozzle, the first valve may be closed and the second valve communicating with that next nozzle may be opened, thereby actuating that nozzle to again move force the debris into the effective range of the third nozzle. This procedure may be followed until the debris has been washed into the downspout by the last nozzle. The debris is flushed out of the drainage system through the open extension 27 of the strainer assembly 14, since the portion of the strainer assembly 14 below the open extension 27 is blocked by the stopper disc 24.

For a more sanitary flushing of the drainage system, a perforated bag 43 may be operatively attached to the open extension 27 by any means known in the art, such as an elastic band of the like, so that, as the eave trough 11 and downspout 12 are purged, the debris flushed therefrom can be collected in the bag 43 while the water is allowed to escape through the perforations in the bag 43. The bag may then be removed and the debris disposed of in an appropriate manner. It is contemplated that the bag 43 will be disposable for such purpose.

Once the purging operation is completed, the stopper disc 24 may again be removed from the lower end 26 of the strainer assembly 14 by gripping the post 41 and removing the disc 24 through the open extension 27. The strainer 23 may be replaced within the upper end 25 of the strainer assembly 14 as noted hereinabove, and the cap may be replaced on the open extension 27 to close it. The drainage system is then returned to its normal operation.

Thus it should be evident that the cleaning system and methods of the present invention are highly effective in removing debris from the eave trough and downspout without subjecting the cleaning person to dangerous conditions or subjecting him to move between locations in order to purge the drainage system. The strainer assembly of the present invention is particularly suited for use in conjunction with a downspout, but is riot necessarily limited thereto. The assembly and method for use thereof can be used separately with other equipment, methods and the like. For example, one alternative to the use of the conduit assembly 13 is a spray arm 44 which is not attached to the eave trough 11 or the downspout 12. Instead, the spray arm 44 includes a handle 45 and a staff-like or goose-necked body member 46 extending therefrom. A spray nozzle 47 is operatively positioned at the end of body member such that the spray arm 44 may be lifted above the height of the roof line and water sprayed into the eave trough 11 at angles sufficient to loosen any debris and move it toward the downspout 12. A fitting 48, similar to the one at the end of the conduit 13, is positioned at the bottom of the handle for attachment to a hose 20 or similar means.

Based upon the foregoing disclosure, it should now be apparent that the use of the cleaning system described herein will carry out the aspects set forth hereinabove. It is, therefore, to be understood that any variations evident fall within the scope of the claimed invention and thus, the selection of specific component elements can be determined without departing from the spirit of the invention herein disclosed and described. In particular, as noted hereinabove, the cap 28 according to the present invention are not necessarily limited to being threadably attached. Other means of attachment generally well known in the art may be substituted therefor. Moreover, as noted hereinabove, other means for locking the strainer 23 into place can be substituted for the preferred embodiment detailed hereinabove. Thus, the scope of the invention shall include all modifications and variations that may fall within the scope of the attached claims.

What is claimed is:

1. A cleaning system for an eave trough and a downspout comprising:

conduit means extending along the downspout and at least a portion of the length of the eave trough for carrying water therethrough;

means connected to said conduit means for spraying water into the eave trough in the general direction of the downspout; and a strainer assembly interposed with the downspout and including a T-shaped housing having an open upper end, an open lower end, and an open extension extending orthogonally between said upper end and said lower end, strainer means operatively attached at said upper end within said housing for collecting any debris which may pass through the downspout; and stopper means selectively removable from said lower end of said housing for redirecting the flow of water during cleaning;

said open extension providing an access for removing said strainer means and said stopper means as desired.

2. A cleaning system according to claim 1, wherein said strainer assembly further includes cap means for selectively closing said open extension.

3. A cleaning system according to claim 1, wherein said conduit means extends the entire length of the eave trough and includes a fitting for attaching a hose to carry water from a source under pressure.

4. A cleaning system according to claim 1, wherein said means for spraying is a plurality of spray nozzles operatively positioned so that water is sprayed into the eave trough toward a junction of the eave trough and the downspout.

5. A cleaning system according to claim 1, wherein said strainer means includes a generally frusto-conical strainer and wherein said strainer includes at least two ears extending radially outwardly from said strainer which are operatively engaged to and lie upon complementary ribs projecting inwardly from said upper end of said housing.

6. A cleaning system according to claim 1, wherein said lower end of said housing includes a circumferential lip extending inwardly therefrom and wherein said stopper means is a circular disc which may be placed on said circumferential lip to keep water and debris from flowing into said lower end of said housing.

7. A cleaning system according to claim 6, wherein said disc is inclined away from said open extension such that water and debris is gravitationally forced through said open extension.

8. A cleaning system according to claim 1, further including bag means operatively attached to said open extension for collecting any debris purged from the eave trough and downspout.

9. A cleaning system according to claim 1, wherein said conduit means includes a separate spray arm.

10. A cleaning system according to claim 1, wherein said conduit means includes a plurality of individual conduits and wherein the cleaning system further comprising valve means for selectively actuating said individual conduits.

11. A strainer assembly comprising:

a generally T-shaped housing having an open upper end, an open lower end, and an open extension extending orthogonally between said upper end and said lower end, strainer means operativelly attached at said upper end within said housing for collecting any debris which may pass through the assembly; and stopper means selectively removable from said lower end of said housing;

said open extension providing an access for removing said strainer means and said stopper means as desired.

12. A strainer assembly according to claim 11, further including cap means for selectively closing said open extension.

13. A strainer assembly according to claim 11, wherein said strainer means includes a strainer having a plurality of ears extending outwardly and wherein said upper end of said housing includes a like number of ribs complementary to said ears such that said ears may be inserted between said ribs and twisted so as to lie upon said ribs, thereby securely fastening said strainer in place in said housing.

14. A strainer assembly according to claim 13, wherein said strainer is frustoconical.

15. A strainer assembly according to claim 11, wherein said stopper means includes a disc selectively removable from said housing and operatively engaging a circumferential lip projecting inwardly from the lower end of said housing.

16. A strainer assembly according to claim 15, wherein said disc is inclined away from said open extension such that water and debris is gravitationally forced through said open extension.

17. A strainer assembly according to claim 11, wherein said housing includes bleed-off means operatively affixed to the inside of said housing and extending above and below said strainer means to permit the escape of water when said strainer means is clogged.

* * * * *